United States Patent [19]

Chapman

[11] 4,447,029

[45] May 8, 1984

[54] LOAD SUPPORT ARRANGEMENT

[75] Inventor: Leslie J. Chapman, Alresford, England

[73] Assignee: Keith Hancock Structures Limited, Alton, England

[21] Appl. No.: 367,152

[22] Filed: Apr. 12, 1982

[30] Foreign Application Priority Data

Jun. 23, 1981 [GB] United Kingdom ..... 8119339

[51] Int. Cl.[3] ..... A47G 29/02

[52] U.S. Cl. ..... 248/246; 108/108; 211/193

[58] Field of Search ..... 248/243, 246, 235, 239, 248/241, 245, 247; 108/108; 211/193

[56] References Cited

U.S. PATENT DOCUMENTS

| | | | |
|---|---|---|---|
| 3,212,648 | 10/1965 | Baker et al. | 248/243 X |
| 3,251,478 | 5/1966 | Frazier | 248/245 X |
| 3,335,992 | 8/1967 | Frazier | 248/245 |
| 3,489,291 | 1/1970 | Frazier | 211/193 |
| 3,554,477 | 1/1971 | D'Altrui | 248/245 |
| 3,602,374 | 8/1971 | Alabaster | 248/243 |
| 3,698,566 | 10/1972 | D'Altrui | 211/193 |
| 3,918,590 | 11/1975 | D'Altrui | 248/245 X |
| 4,023,684 | 5/1977 | Saul | 248/243 X |

*Primary Examiner*—J. Franklin Foss

*Attorney, Agent, or Firm*—Robert E. Isner

[57] ABSTRACT

A load support system including a plurality of cantilever shelf elements each having a selectively shaped and oriented bracket assembly at one end thereof for conjointly permitting vertical displacement of the cantilever shelf elements relative to a vertical standard and locking thereof in selected load-bearing location in response to angular disposition of said shelf element relative to said standard.

6 Claims, 3 Drawing Figures

LOAD SUPPORT ARRANGEMENT

This invention relates to a load support arrangement and is particularly though not exclusively applicable to shelf storage systems based on a cantilever support principle.

In the provision of shelving systems for storage purposes, in order to provide flexibility of the system, there are provided upright members to which a cantilever unit is secured so as to be adjustable. With a cantilever system, it is necessary for the cantilever arms to be secured at the support end and these have been made adjustable by providing either a finite number of different positions at which the cantilever arms can be fixed or, where complete variable adjustment is required, the fixing has relied upon simple clamping arrangement to hold it in place.

This later system has the disadvantage of requiring use of relatively strong clamps to avoid any slipping of the cantilever arm or in providing set screw like arrangements whereby slipping is prevented by the fact that the screw makes a dent in the vertical support. Even then the security of the cantilever arm depends upon the tightness of the clamp or screw and the weight of the load which is placed thereon.

The present invention seeks to provide a load support arrangement in which some of all of the above mentioned disadvantages of the existing arrangements are reduced or avoided and which provides an infinitely adjustable support arrangement which is of high security.

According to the invention there is provided a support arrangement comprising a main upright provided with a slideway, a cantilever arm having means cooperating with the slideway for guiding the arm along the slideway, engagement means engaging the upright in opposite directions at two portions spaced vertically and arranged to cause engagement of the engagement means with the upright to hold the cantilever arm in position on the upright on movement of the cantilever arm in a loading direction and locking means for canting the engagement means in a horizontal plane relatively to the upright for stressing the engagement between the engagement means and the upright to provide a locking action.

Preferably the engagement means comprises a first engagement element to the rear of the arm in engagement with a first vertical surface of the upright and a second engagement means situated below and spaced forwardly from the first engagement means in use and engageable with an opposite surface of the upright to the first engagement means.

In a preferred form of the invention, the upright comprises an I-section bar, two adjacent flanges of which form guide means for the cantilever arm. The cantilever arm is provided with two pairs of right angled brackets each pair being welded or otherwise fastened to the cantilever arm in back to back relationship by a first arm leaving the other arms extending parallel to each other and spaced by a distance related to the thickness of the flange from the I-section upright, the said two adjacement flanges on the upright being slidable between the two angled brackets of each pair, the rear angled brackets extending upwardly from the cantilever arm and the front angled brackets extending downwards from the cantilever arm.

The locking means in this case may suitably comprise means for horizontally canting the angled brackets in relation to the flanges of the I-section bar when the cantilever arm is in position so that the right angled brackets are caused to grip rightly onto the upright. In a particular form of this arrangement, the cantilever arm may be formed of two members, one on each side of the I-section beam, each member carrying a pair of angled brackets. The two cantilever members are connected together at their outer ends in an adjustable manner whereby their spacing at their outer ends is adjustable between a first position of the arm members for sliding up and down the I-section bar and a second position of the arm members in which there is a reduced spacing of the outer ends of the arm members so that the angled brackets are canted to grip the I-section bar.

The invention will now be described in greater detail, by way of example, with reference to the drawings, in which.

Figure 1:
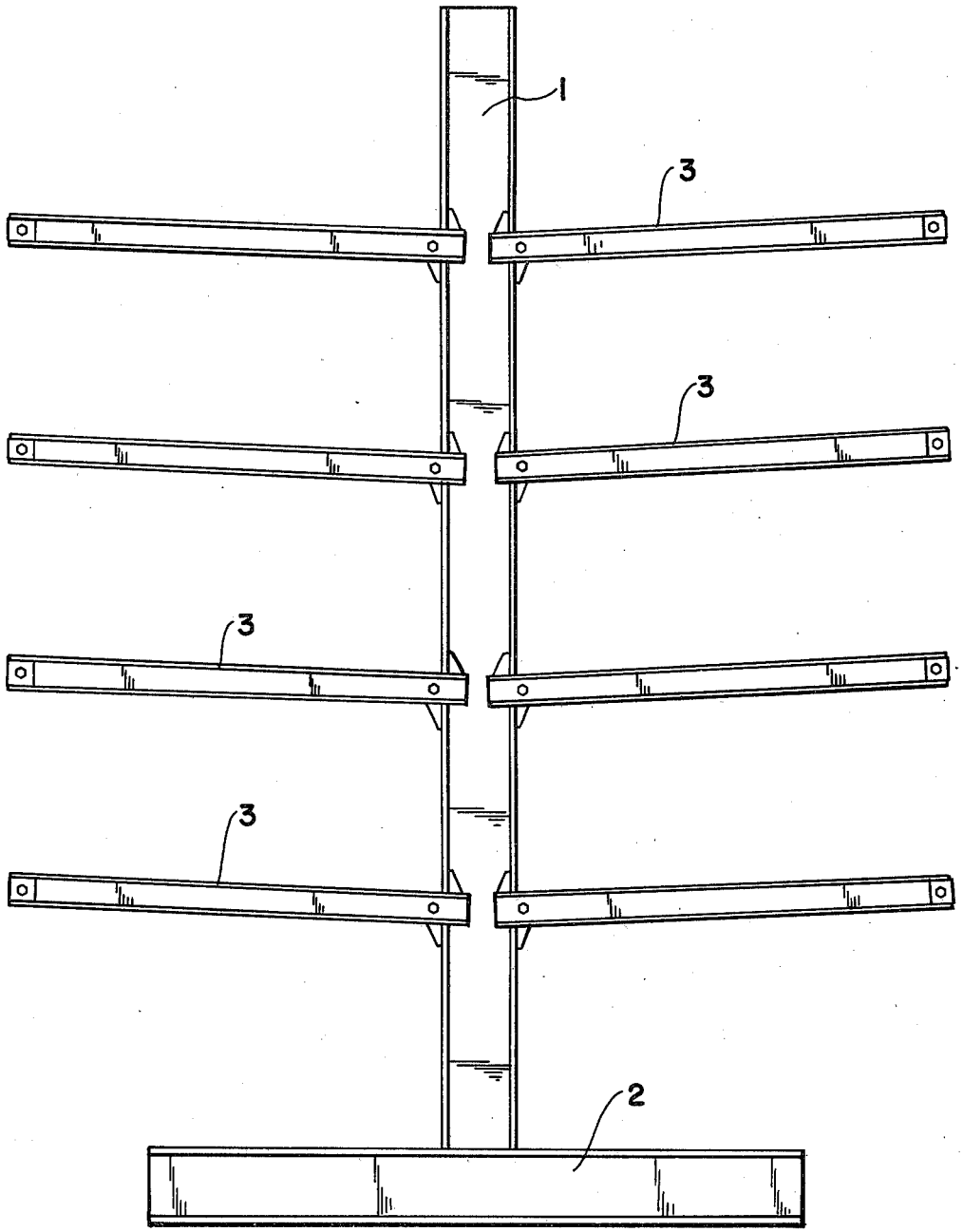
FIG. 1 is a side view of an upright carrying a number of cantilever supports on both sides.

Referring firstly to FIG. 1, there is shown an end view of a load support arrangement in accordance with the invention. This comprises an I-section upright 1 which is supported on a similar I-beam 2 extending horizontally at the bottom. Positioned at intervals vertically of the upright 1 are eight cantilever support elements 3, four to each side of the upright. In use these cantilever supports will be associated with further uprights and cantilever supports which in combination act to support articles to be stored, either directly on the beam of the cantilever elements or of the shelving placed thereon.

Figure 2:
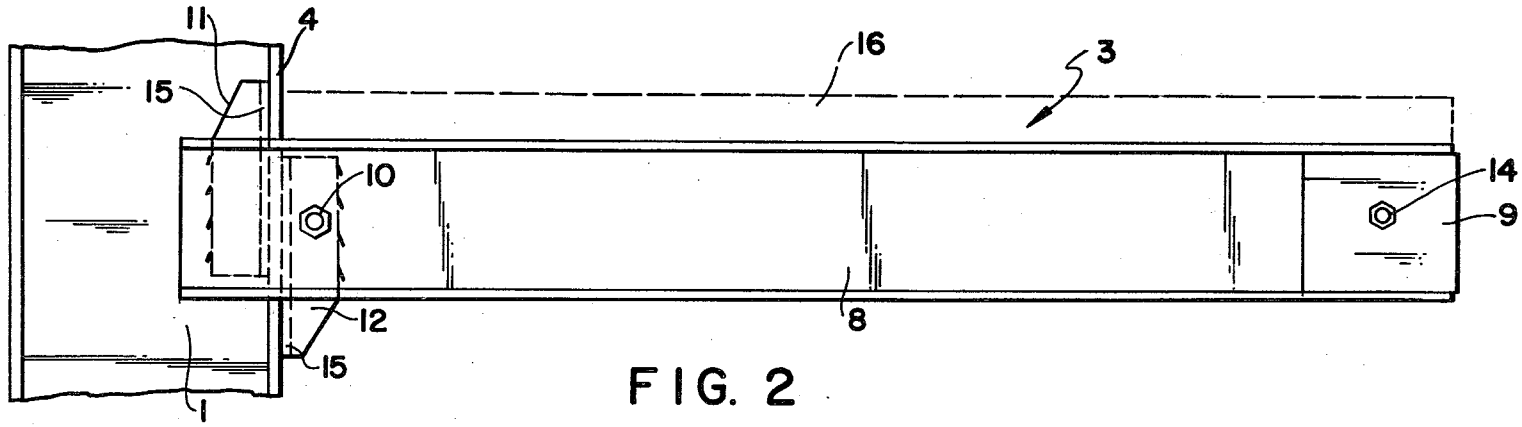
FIG. 2 is a side elevation of a cantilever support arm in position on the upright in greater detail.
Figure 3:
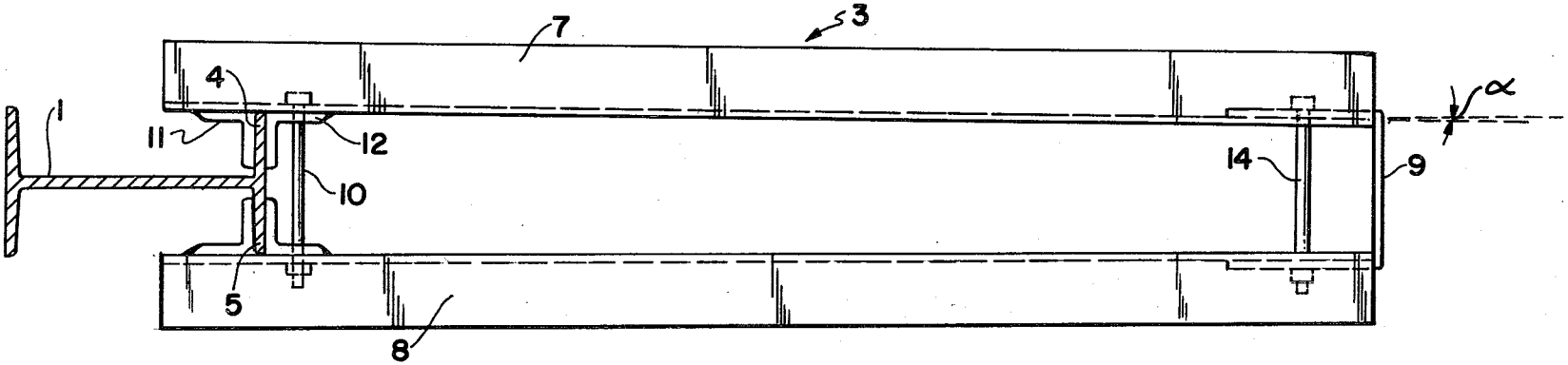
FIG. 3 is a plan view of the arm with the upright section for clarity.

The more detailed construction of the cantilever support elements can be seen from FIGS. 2 and 3.

As mentioned the cantilever arm 3 is supported on the I-section upright 1 (suitably of a rolled steel beam 1) its two flanges 4 and 5 which are adjacent to each other provide guide elements for the cantilever element 3.

The cantilever arm 3 suitably comprises two arm elements 7 and 8 which may be of channel shape is shown or may be angled, the arm elements being connected spaced apart at one end by a channel section bracket 9 and at the other end by a clamping bolt 10.

At the upright end, each arm element 7 or 8 is provided with a pair of angled members 11 and 12 forming torsion brackets which may suitably be welded to the arm elements 7 or 8. As can be seen particularly from FIG. 3, these angled brackets 11 and 12 are mounted back to back leaving a spacing therebetween which is of the order of the thickness of the flanges 4 and 5. As particularly seen from FIG. 2, the outer angled bracket 12 extends below the arm elements while the inner angled bracket 11 extends above the arm elements. From FIG. 3 it will be seen that while the two arm elements 7 and 8 are substantially parallel, they are in fact, in use, inclined towards each other by twice the angle $\alpha$ for a purpose which will be described hereafter.

A better understanding of the arrangement can be obtained from the following description of the operation of the assembly of the arm elements 7 and 8 onto the upright 1.

Two or more uprights 1 are located in the required position and are connected together by means of suitable cross bracing (not shown) and are then ready for assembly of the cantilever arm 3. The two arm elements 7 and 8 of end cantilever arm are initially separate and one element is placed on each side of the I-beam 7 so that the flanges 4 and 5 of I-beam are located within the channel formed by the two angled brackets 11 and 12. The position of the cantilever arm 3 is then adjusted up and down the upright 1 to the required position, where necessary, and in this position the free ends of the arm elements 7 and 8 are brought towards each other by a small amount so that they make an angle of $\alpha$ with the otherwise parallel lines which they would take up. This angle is not in itself critical and will be determined by the size of the bracket 9 which is used to connect the free ends together. An angle of between 0.5° and 6° has been found to be sufficient. With the free ends of the arm elements 7 and 8 pressed towards each other, the bracket 9 is inserted into the channel portions of the arm elements 7 and 8 and secured by means of a nut and bolt arrangement 14 as shown particularly in FIG. 3. The effect of the angled position of the arm elements 7 and 8 causes a canting of the right angled brackets 11 and 12 in relation to the flanges 4 and 5 of the upright 1 and will cause the cantilever to be firmly wedged in position. The positioning of the angled brackets 11 and 12 provides load locking of the cantilevers since the weight of the cantilever and also any load placed thereon will cause a pivotable action of the cantilever arm 3 and cause pressure of the outer ends 15 of the torsion brackets 11 and 12 on the guide flanges 4 and 5 of the upright thus maintaining the cantilever arms in position. The canting of the brackets 11 and 12 causes firm wedging which is sufficient to withstand any possible tendency of the cantilever to slip down the upright even in the case of substantial impact loads on the cantilever.

The bolt 10 provided at the upright end of the cantilever arm 3 may be used to ensure that the flanges 4 and 5 abut the arms 7 and 8 at the bottom of the grooves between the brackets 11 and 12. This provides additional security. Also the bolt can be used to hold the arm elements in position on the upright while the angle adjustment is taking place.

The cantilever arms may themselves be used to support the load or shelving, such as that indicated at 16 may be placed thereon.

It will be appreciated that various modifications may be made to the above described embodiment without departing from the scope of the invention. For example the torsion brackets may be spaced entirely apart longitudinally in the upright so that they do not provide any overlap. Although the torsion brackets have been described as being welded these may in fact be secured by other means such as bolting. While the arrangement described in connection with FIGS. 2 and 3 has related to the attachment of the single arm on one side of the upright, arms may be provided on one or both sides of the upright as shown in FIG. 1.

As can be seen from FIG. 1, it may be described for the cantilever arms, when in the unloaded state to be angled slightly in an upward direction. This enables the cantilever to take up the effect of the load places thereon without this causing the downward angling of the cantilever arms and thus successfully ensuring that the goods being stored thereon do not slip off. Furthermore this will act an indicator in that when the cantilever arms approach the horizontal, the maximum rated load has been reached.

Various additional elements may be provided for use with the above described embodiment. For example upright members may be provided on the brackets 9 to return a load, such as pipes or tubes, in position. Cross members may also be provided between cantilever arms on adjacent uprights to support the front and/or rear of shelving placed thereon.

What is claimed is:

1. A cantilever storage rack support arrangement, comprising a vertical support standard including at least one extending flange forming a slideway, a cantilever arm selectively positionable along the length of said vertical support standard and having a free end remote therefrom displaceable in a horizontal plane, first and second plate members mounted on said cantilever arm remote from the free end thereof and normally disposed in sliding interfacial relation with said extending flange for guiding said cantilever arm along said slideway, said first plate member having a lower marginal edge portion and said second plate member having an upper marginal edge portion disposable in progressively increasing compressive engagement on opposite sides of said extending flange in response to vertical loading of said cantilever arm towards a horizontal position to hold said cantilever arm in selected position on said upright when under load, at least one of said plate members having a side marginal edge portion cantable into compressive engagement with said flange in response to horizontal displacement of the free end of said cantilever arm to maintain said cantilever arm in selected position on said support standard preparatory to load application thereto.

2. The storage rack support arrangement as set forth in claim 1 wherein said extending flange on said vertical support standard provides a pair of parallel, spaced apart surfaces, one facing toward the free end of said cantilever arm and the other away therefrom, said first plate member is disposed in interfacial relation with the surface of said flange facing toward the free end of said cantilever arm and has its lower marginal edge disposed beneath said cantilever arm and its side marginal edge cantable into compressive engagement with said flange in response to said horizontal displacement of said free end of said cantilever arm, and said second plate member is disposed in interfacial relation with the surface of the flange facing away from the free end of said cantilever arm and has its upper marginal edge disposed above said cantilever arm.

3. A cantilever storage rack support arrangement comprising an I type section vertical support standard having a pair of coplanar extending flanges, forming a slideway, a cantilever arm assembly formed of a pair of arm members disposed on either side of said extending flanges and having the remote free ends thereof horizontally displaceable toward and away from each other, first and second plate members mounted on each of said cantilever arm members remote from the free ends thereof and normally disposed in sliding interfacial relation with said respective extending flanges for guiding said cantilever arm assembly along said slideway, each of said first plate members having a lower marginal edge portion and each of said second plate members having an upper marginal edge portion disposable in progressively increasing compressive engagement on opposite sides of said extending flanges in response to vertical loading of said cantilever arm assembly towards a horizontal position to hold said cantilever arm assembly in selected position on said upright when under load, each of said first plate members having a side marginal edge portion cantable into compressive engagement with said flanges in response to selective horizontal displacement of the free ends of said cantilever arms toward each other to maintain said cantilever arm assembly in selected position on said support standard preparatory to load application thereto.

4. The storage rack support arrangement as set forth in claim 3 wherein each of said extending flanges on said vertical support standard provides a pair of essentially parallel, spaced apart surfaces, one facing toward the free end of said cantilever arm assembly and the other away therefrom, each of said first plate members is disposed in interfacial relation with a surface of said flange facing toward the free end of said cantilever arm assembly and has its lower marginal edge disposed beneath said cantilever arm assembly, and each of said second plate members is disposed in interfacial relation with a surface of said flange facing away from the free end of said cantilever arm assembly and has its upper marginal edge disposed above said cantilever arm assembly.

5. The storage rack support arrangement as set forth in claim 3 including means for biasing the free ends of said cantilever arm members towards each other and for securing said ends in biased condition.

6. The storage rack support arrangement as set forth in claim 5 further including means disposed intermediate said cantilever arm members adjacent the free ends thereof for limiting the degree of displacement thereof towards each other.

* * * * *